US007095378B1

(12) United States Patent
Paquette

(10) Patent No.: US 7,095,378 B1
(45) Date of Patent: Aug. 22, 2006

(54) SATELLITE DISH SIGHTING APPARATUS AND ALIGNMENT SYSTEM

(76) Inventor: Fred Paquette, P.O. Box 357, Cashmere, WA (US) 98815

( * ) Notice: Subject to any disclaimer, the term of this patent is extended or adjusted under 35 U.S.C. 154(b) by 48 days.

(21) Appl. No.: 11/046,508

(22) Filed: Jan. 28, 2005

Related U.S. Application Data

(60) Provisional application No. 60/539,839, filed on Jan. 28, 2004.

(51) Int. Cl.
*H01Q 3/00* (2006.01)

(52) U.S. Cl. ..... 343/757; 343/892; 33/268; 33/273

(58) Field of Classification Search ..... 343/757, 343/765, 880, 882, 892; 33/268, 273
See application file for complete search history.

(56) References Cited

U.S. PATENT DOCUMENTS

| | | | | |
|---|---|---|---|---|
| 4,138,826 | A | 2/1979 | Inge | |
| 4,495,706 | A | 1/1985 | Kaminski | |
| 4,691,207 | A | 9/1987 | Timineri | |
| 5,274,926 | A | 1/1994 | Dillon | |
| 5,276,972 | A | 1/1994 | Staney | |
| 5,296,862 | A | 3/1994 | Rodeffer et al. | |
| 5,471,219 | A | 11/1995 | Rodeffer et al. | |
| 5,585,804 | A | 12/1996 | Rodeffer | |
| 5,646,638 | A | 7/1997 | Winegard et al. | |
| 5,647,134 | A | 7/1997 | Shiau-fong | |
| 5,734,356 | A | 3/1998 | Chang | |
| 5,760,739 | A | 6/1998 | Pauli | |
| 5,808,583 | A | 9/1998 | Roberts | |
| 5,870,059 | A | 2/1999 | Reynolds | |
| 5,894,674 | A | 4/1999 | Feldman | |
| 5,903,237 | A | 5/1999 | Crosby et al. | |
| 5,923,288 | A | 7/1999 | Pedlow, Jr. | |
| 5,940,028 | A | 8/1999 | Iwamura | |
| 5,945,945 | A | 8/1999 | Wagner et al. | |
| 5,977,922 | A | 11/1999 | Hemmingsen, II | |
| 5,999,139 | A | 12/1999 | Benjamin et al. | |
| 6,031,508 | A | 2/2000 | Ishizuka et al. | |
| 6,037,913 | A | 3/2000 | Johnson | |
| 6,081,240 | A | 6/2000 | Hemmingsen, II | |
| 6,124,836 | A | 9/2000 | Rogers | |
| 6,229,480 | B1 | 5/2001 | Shintani | |
| 6,512,492 | B1 * | 1/2003 | Overton | 343/891 |
| 6,526,667 | B1 | 3/2003 | Staney | |
| 6,538,612 | B1 | 3/2003 | King | |
| 6,538,613 | B1 * | 3/2003 | Pursiheimo | 343/757 |
| 6,682,029 | B1 | 1/2004 | Dierkes | |
| 6,683,581 | B1 | 1/2004 | Matz et al. | |
| 6,697,026 | B1 | 2/2004 | Hemmingsen, II | |
| 6,710,749 | B1 | 3/2004 | King | |
| 6,762,731 | B1 * | 7/2004 | Chou | 343/882 |

(Continued)

OTHER PUBLICATIONS

"Satellite Finder Home Page", http://vps.arachnoid.com/satfinder/index.html, (Nov. 19, 2004),4.

*Primary Examiner*—Hoang V. Nguyen
(74) *Attorney, Agent, or Firm*—Vidal A. Oaxaca; Peacock Myers, P.C.

(57) ABSTRACT

An apparatus and method for setting up a satellite dish to receive satellite signals, including television satellite signals, with precise positioning and aiming of the satellite dish, including determination of a clear line of sight, azimuth orientation, elevation angle and skew or tilt angle. The apparatus includes a line of sight mechanism removably attachable to a satellite dish.

20 Claims, 9 Drawing Sheets

U.S. PATENT DOCUMENTS

| | | | | |
|---|---|---|---|---|
| 6,906,673 | B1 * | 6/2005 | Matz et al. | 343/760 |
| 2002/0005816 | A1 | 1/2002 | Ginther et al. | |
| 2002/0083573 | A1 | 7/2002 | Matz et al. | |
| 2002/0083574 | A1 | 7/2002 | Matz et al. | |
| 2002/0084941 | A1 | 7/2002 | Matz et al. | |
| 2003/0080898 | A1 | 5/2003 | Wang et al. | |
| 2003/0214449 | A1 | 11/2003 | King | |
| 2004/0160375 | A1 | 8/2004 | King | |
| 2004/0169114 | A1 | 9/2004 | Bierkes | |

* cited by examiner

SATELLITE DISH SIGHTING APPARATUS AND ALIGNMENT SYSTEM

CROSS-REFERENCE TO RELATED APPLICATION

This application claims the benefit of the filing of U.S. Provisional Patent Application Ser. No. 60/539,839 entitled "Satellite Dish Sighting Apparatus And Dish Alignment System", filed on Jan. 28, 2004, and the specification thereof is incorporated herein by reference.

BACKGROUND OF THE INVENTION

1. Field of the Invention (Technical Field)

The present invention relates to an apparatus, system and method for sighting, setting up and aligning a satellite dish to receive satellite signals, including but not limited to television satellite signals.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Setting up a satellite dish to receive television or other satellite signals requires the precise positioning and aiming of the satellite dish. The satellites are "parked" in geosynchronous orbit, typically 22,300 miles above the equator, and travel at the exact same rate as the earth's rotational speed so they appear stationary. To obtain a good signal, the satellite dish must be pointed precisely (within 2 degrees in all directions) and directly at the satellite (the "look angle"), with no obstructions between the two. This means that no trees, buildings, mountains, hills, wood, brick, metal, leaves, or other obstructions can be positioned within the line of sight between the dish and the satellite.

In addition to the difficulty of finding a clear line of sight, a level spot must also be found to place the dish stand or dish mount, and the mounting pole must also be level. If the dish mounting pole is not perfectly level, not only are the molded or stamped alignment markings on the dish inaccurate, but as one axis of the dish alignment is adjusted, the alignment of the other axis, if it was previously set, becomes misaligned. The conventional process for aligning a satellite dish can become an extremely aggravating process. The current dual low noise block down converter satellite dishes which employ a single feed horn (LNB) to pick up waves from two satellites placed close to each other in space in geosynchronous orbit and newer modern multi-satellite dishes (which can pick up waves from three satellites) are even more difficult as they require an additional axis of the satellite dish (generally referred to as "skew", "tilt" or "polarization") to also be accurately aligned in order to receive signals from either two or three satellites at the same time.

Because the satellite signal is a digital signal, the person who is setting up the dish must wait from 5 to 10 seconds between adjustments of the dish for the receiver to "catch up" with the signal and show up on the television. This process of adjustment, waiting, and analysis of the results on the television must be repeated multiple times in order to obtain an acceptable satellite signal. Thus it is a time-consuming and difficult procedure to align a dish for optimal reception from a given satellite.

A number of patents and patent applications disclose devices and methods for aligning satellite dishes. However, all devices and methods heretofore described have significant limitations. For example, U.S. Pat. No. 4,495,706 discloses an alignment gage that determines azimuth and altitude, but does not provide for a third skew axis. It also lacks a method or structure for determining obstructions in the line of sight. This device also requires that the dish stand or mount be level. U.S. Pat. No. 5,276,972 discloses a gage that allows verification of a clear line of sight; however, it is only for site selection, and is not employed in aiming of a satellite dish. It also does not provide for a third skew axis. U.S. Pat. No. 5,274,926 discloses a complex sphere assembly, requiring a map of the earth's surface served by the satellite, and utilizing spherical trigonometry to determine reference points. U.S. Pat. Nos. 5,647,134, 5,734,356, 5,894,674, 5,977,922, and 6,081,240 provide a gage mounted to a satellite dish, but do not provide for a third skew axis, lack a method or structure for determining obstructions in the line of sight, and require that the dish stand or mount be level. Other devices, such as those disclosed in U.S. Pat. Nos. 5,296,862, 5,585,804, 5,471,210, 6,538,612, 6,710,749 and Patent Application Nos. 2003/0214449 and 2004/0160375, incorporate complex electronic systems, as well as lacking means for determining a third skew axis and lacking methods or structure for determining obstructions in the line of sight. U.S. Pat. No. 6,683,581 and Patent Application Nos. 2002/0084941 and 2002/0083574 disclose electronic gages which include a third skew axis determination, but lack methods or structure for determining obstructions in the line of sight.

Thus while a number of devices and methods provide partial solutions to the problems of aligning satellite dishes, each prior art device and method has significant limitations. An ideal device is mechanical, can be used to determine a suitable line of sight both prior to placement of the satellite dish and after placement of the satellite dish, permits orientation in three dimensions (altitude, azimuth and skew), can be removably mounted on the satellite dish, and can be set to the appropriate dimensions for a given satellite (again altitude, azimuth and skew) prior to alignment of a dish, such that only two variables, magnetic north on a compass and level, such as by means of bubble levels, need to be ascertained in order to have the dish properly aligned. Additionally, a device is preferably non-ferrous, so as to not interfere with compass orientation, and is a sufficient distance from a metal structure of a dish so as to not interfere with compass orientation. It is against this background, and in order to provide a device addressing these parameters, that the present invention was developed.

BRIEF SUMMARY OF THE INVENTION

The invention provides a device for selection of a clear line of sight for a satellite dish and for aligning a satellite dish, the device including a body with a viewing tube for viewing a line of sight; a first bracket attached to the body and rotatably movable around a line coaxial with the line of sight of the viewing tube; and a second bracket attached to the first bracket, and rotatably movable along a line perpendicular to the line coaxial with the line of sight of the viewing tube, the second bracket including a compass and at least one level indicator, and preferably made from materials that do not exhibit ferromagnetism. In a preferred embodiment, the viewing tube includes two elongated segments at a non-zero angle one to the other and an optical component whereby light is transmitted at the non-zero angle of the two segments. Most preferably, the two segments are at a right angle one to the other, and the optical component includes a mirror or a prism. In the case of a right angle viewing tube, the optical component can include two mirrors, with each mirror disposed at a 45° angle to the axis of light transmission, so that light is transmitted along the viewing tube at a 90° angle.

In the device the first bracket preferably includes degree markings for setting a skew angle of the first bracket to the body, and separately degree markings for setting an elevation angle of the first bracket to the second bracket. The compass preferably includes a rotatable element with directional markings for setting an azimuth angle with respect to the line of sight of the viewing tube. The second bracket preferably includes two level indicators, with a first level indicator parallel to line of sight of the viewing tube and a second level indicator perpendicular to the line of sight of the viewing tube. In a preferred embodiment, the first level indicator and the second level indicator are tubular bubble levels. The viewing tube subsumes a defined angular field of view, preferably an angle between about 3° and about 9°.

The device can further include a mounting bracket with a securing member for securing the body to the mounting bracket and an adjustable member for adjustably mounting the mounting bracket to a satellite dish. The adjustable member may be adjusted such that the line of sight of the viewing tube is coaxial with the satellite reception line for the satellite dish. The securing member can include at least one groove with the body including at least one complementary rail, such that the body can be removably secured to the mounting bracket. In a preferred embodiment, the adjustable member includes at least one elongated structure with a variable length for adjusting the mounting bracket such that the line of sight of the viewing tube is coaxial with the satellite reception line for the satellite dish.

The invention further includes a system for selection of a clear line of sight for a satellite dish and for aligning a satellite dish with respect to a determined satellite, the system including a body with a viewing tube for viewing a line of sight; a first bracket attached to the body and rotatably movable around a line coaxial with the line of sight of the viewing tube; a second bracket attached to the first bracket, and rotatably movable along a line perpendicular to the line coaxial with the line of sight of the viewing tube, the second bracket including a compass and at least one level indicator; a mounting bracket with a securing member for securing the body to the mounting bracket and an adjustable member for adjustably mounting the mounting bracket to a satellite dish, wherein the line of sight of the viewing dish is coaxial with the reception line of the satellite dish with respect to a determined satellite.

The invention further includes a method for aligning a satellite dish with respect to a known geosynchronous satellite, the method including the steps: obtaining the azimuth angle and altitude angle of a known geosynchronous satellite with respect to a defined locale; providing a body with a viewing tube for viewing a line of sight, a first bracket attached to the body and rotatably movable around a line coaxial with the line of sight of the viewing tube, and a second bracket attached to the first bracket, and rotatably movable along a line perpendicular to the line coaxial with the line of sight of the viewing tube, the second bracket comprising a compass and at least one level indicator; rotatably adjusting the second bracket to set the second bracket at an angle to the line of sight corresponding to the altitude angle; orienting the body to a compass angle corresponding to the azimuth angle by means of the compass; and leveling the second bracket by means of at least one level indicator.

The method can further include the steps of obtaining the skew angle of a known geosynchronous satellite with respect to a defined locale; fixing the body to a satellite dish such that the line of sight of the viewing tube is coaxial with the reception line of the satellite dish; and rotatably adjust the first bracket to the set the first bracket at an angle corresponding to the skew angle.

The present invention thus provides an apparatus for setting up a satellite dish to receive television satellite signals with the precise positioning and aiming of the satellite dish. The apparatus preferably comprises the following: a line of sight mechanism with a magnetic compass for azimuth determination and with calibrated levels, and adjustment capabilities that allow for proper alignment to receive satellite signals, such alignment including altitude and skew or tilt. An additional component of the apparatus preferably comprises a mechanism to removably mount the line sighting mechanism to a dish without readjustment of the satellite dish. The present invention is preferably for use with, but is not limited to, satellite dishes used with or mounted on recreational vehicles (RV).

A primary object of the present invention is to provide a "pre-sighting" function to allow an RV to be parked in the proper location to receive the satellite signal with an automatic satellite dish.

Another object of the present invention is to provide devices and methods that will allow parking an RV in any preferred location, such as in a specific campsite of choice, and permit the quick and easy finding of a clear line of sight at some nearby spot to set up a portable dish and receive a good signal.

An advantage of the present invention is that it permits dispensing with finding a level spot on which to place the dish or dish stand.

Another advantage of the present invention is that the dish can be adjusted and aimed completely independent of the mounting pole.

Yet another advantage of the present invention is that inaccurately stamped markings on the dish become completely irrelevant to the dish alignment.

Yet another advantage of the present invention is that problems associated with alignment of one axis causing misalignment of another axis are avoided as all axes are adjusted simultaneously.

Yet another advantage of the present invention is that the time to align a dish, and time to wait for the receiver to "catch up" with the signal and show up on the television, are eliminated or minimized, in that the invention provides components that rely on their own inherent accuracies and adjustments to quickly, easily and precisely aim at the correct satellite(s) independent of any electronic signal from a receiver, television or any other signal meter.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
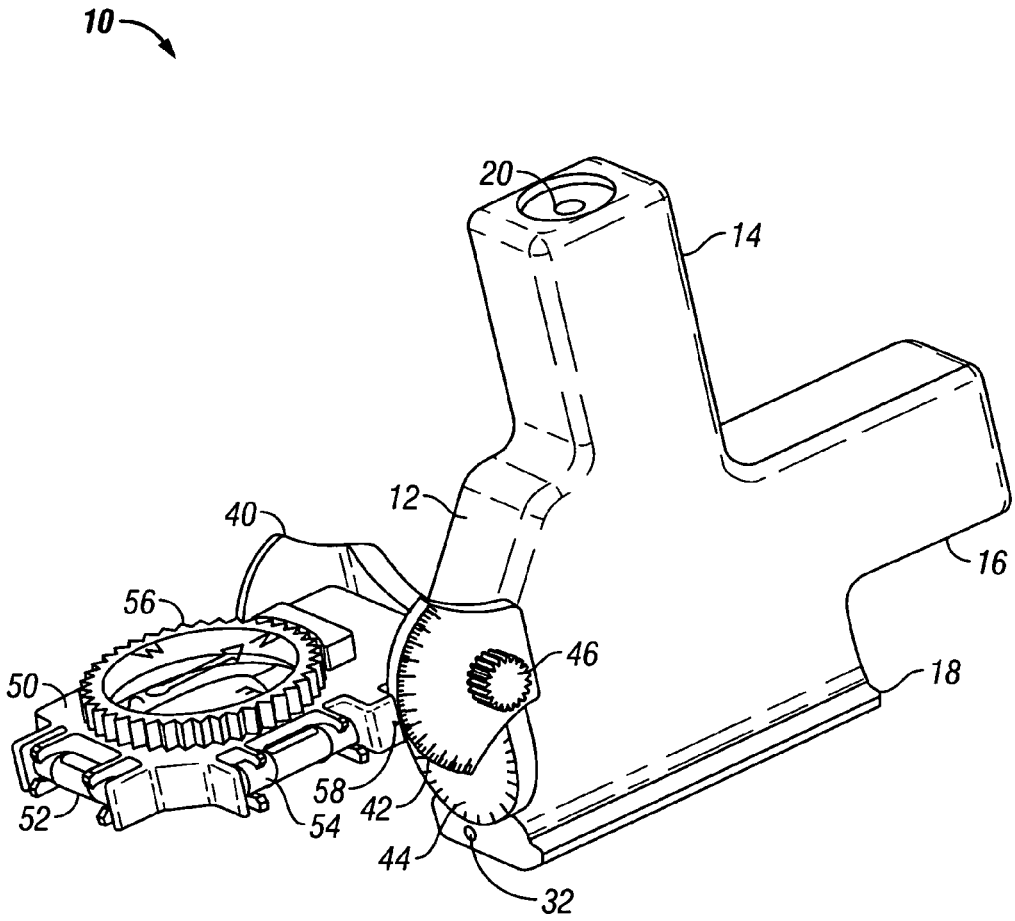
FIG. 1 is a side view of a sighting device of the present invention.

Reference is now made to the drawings which illustrate a preferred embodiment of the invention. As shown therein, FIG. 1 shows a side view of the preferred embodiment of the present invention. FIG. 1 shows the sighting portion with the compass portion attached to the back of the sighting portion.

The preferred embodiment of sighting device 10 is made from a hard plastic or other similar material, most preferably non-ferrous and of a material which does not interfere with a compass (i.e. made from materials that do not exhibit ferromagnetism). Thus PVC, ABS and similar plastics, made by machining, injection molding or similar means, may be employed in the invention.

Figure 2:
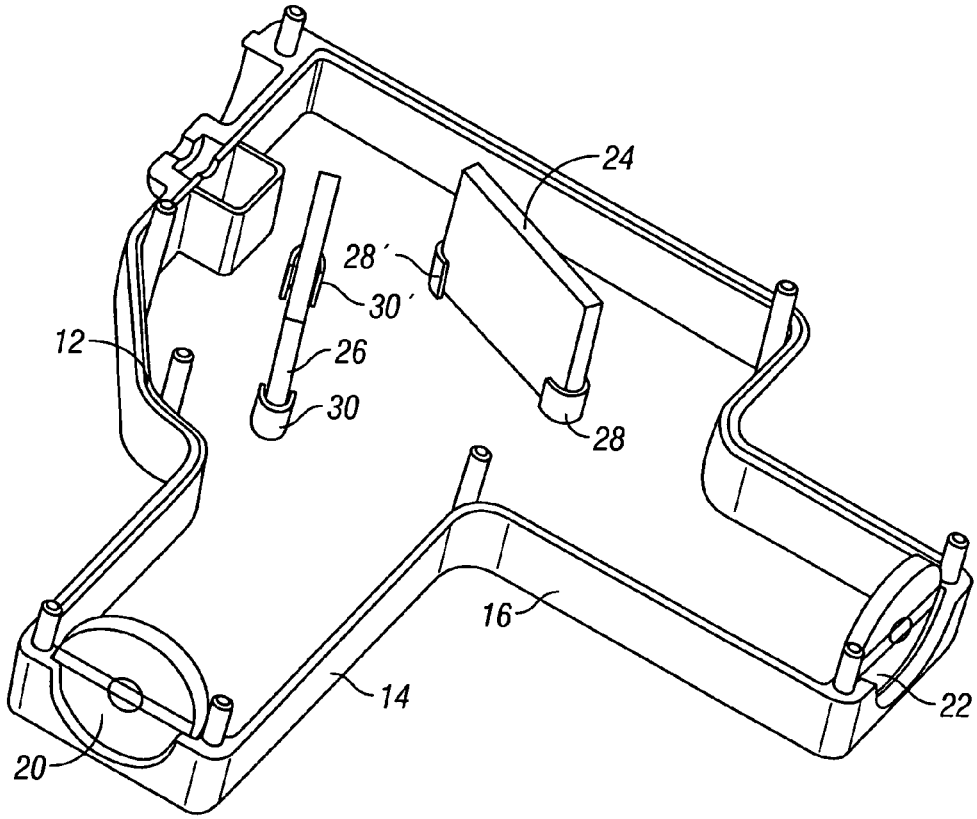
FIG. 2 is a partial view of the interior of a sighting device of the present invention.

The sighting device 10 includes a body 12, preferably made by machining or injection molding of plastic materials, which includes a viewing tube made up of viewing arm 14 and line of sight arm 16. In a preferred embodiment, the two arms 14 and 16 are disposed at a ninety degree angle (90°) one to the other. However, it is possible that the arms are coaxial, as with a conventional telescope or similar viewing tube, or that the arm 14 is at a different angle to the arm 16, such as for example a 60° angle. The viewing tube further includes a viewing lens 20 and a line of sight lens 22, which lenses may be made of clear plastic, such as an acrylic plastic material, glass or other similar transparent material. The lenses 20, 22 may be non-spherical lenses, which do not focus light rays entering or exiting the viewing tube. Alternatively, the lenses may be spherical, such that the viewing tube forms a telescope producing a magnified image of a distant object. Where arms 14 and 16 are at a non-zero angle one to the other, such that the arms are not coaxial, the viewing tube further includes an optical component whereby light is transmitted at the non-zero angle of arm 14 to arm 16. As shown in FIG. 2, wherein arm 14 is at a 90° angle to arm 16, the optical component may include mirrors 24, 26, where each mirror is disposed at a 45° angle, such that the combined result is that light rays entering line of sight lens 22 are bent at a 90° angle so as to be viewed through viewing lens 20. Mirrors 24, 26 are secured by mounting brackets, such as brackets 28, 28' securing mirror 24 and brackets 30, 30' securing mirror 26. Mirrors 24, 26 are made from any material that provides a reflecting surface capable of reflecting light rays with appreciable diffusion. The mirrors 24, 26 are preferably planar, and may be made of transparent material such as glass, acrylic or another plastic material, and may be back silvered or front silvered. Alternatively, other mirror materials may be employed, including but not limited to speculum metal or stainless steel. While use of a two-mirror optical component system is advantageous, it is to be understood that that other optical components may be employed. For example, a single mirror may be employed, a prism may be employed, and so on.

The viewing lens 20 may include a printed or embossed cross-hair, centered square, centered circle or the like, useful in ascertaining the center point of the viewed image, and allowing for simple correction of parallax resulting from the observer's eye not being coaxial with the line of sight. The image viewed through the viewing lens 20 subsumes a defined angular field of view. In general, a clear minimum 3° field of view is required to obtain a signal from a single satellite. That is, in order for a satellite dish to receive a signal, there must be at least a 3° field of view from the mid-line of the satellite dish, centered on the position of the satellite in geosynchronous orbit, which is free and clear of any obstructions, including buildings, trees or other physical obstructions. For a two satellite LNB dish, typically the satellites are separated by a span of 9°. For example, one satellite may be at 101°, and a second satellite at 110°. For a three satellite LNB dish, the third satellite is also at a 90 span difference, such as 119°, such that the clear span must be a total of about at least 18°. By having a field of view of at least about 3°, a clear view for a single satellite may readily be ascertained. In practice, the inventor has found that a field of view of about 5° provides sufficient precision and allows for a margin of error of about 1° to the left and right of the specified angle. The field of view may alternatively be a greater number, such as about 9°, which will permit two satellites to be subsumed within the field of view. However, for two and three satellite reception, it is possible and desirable to look the requisite number of degrees to the left and right, such as by using the compass 56, to ascertain a clear view for multiple satellites.

Figure 3:
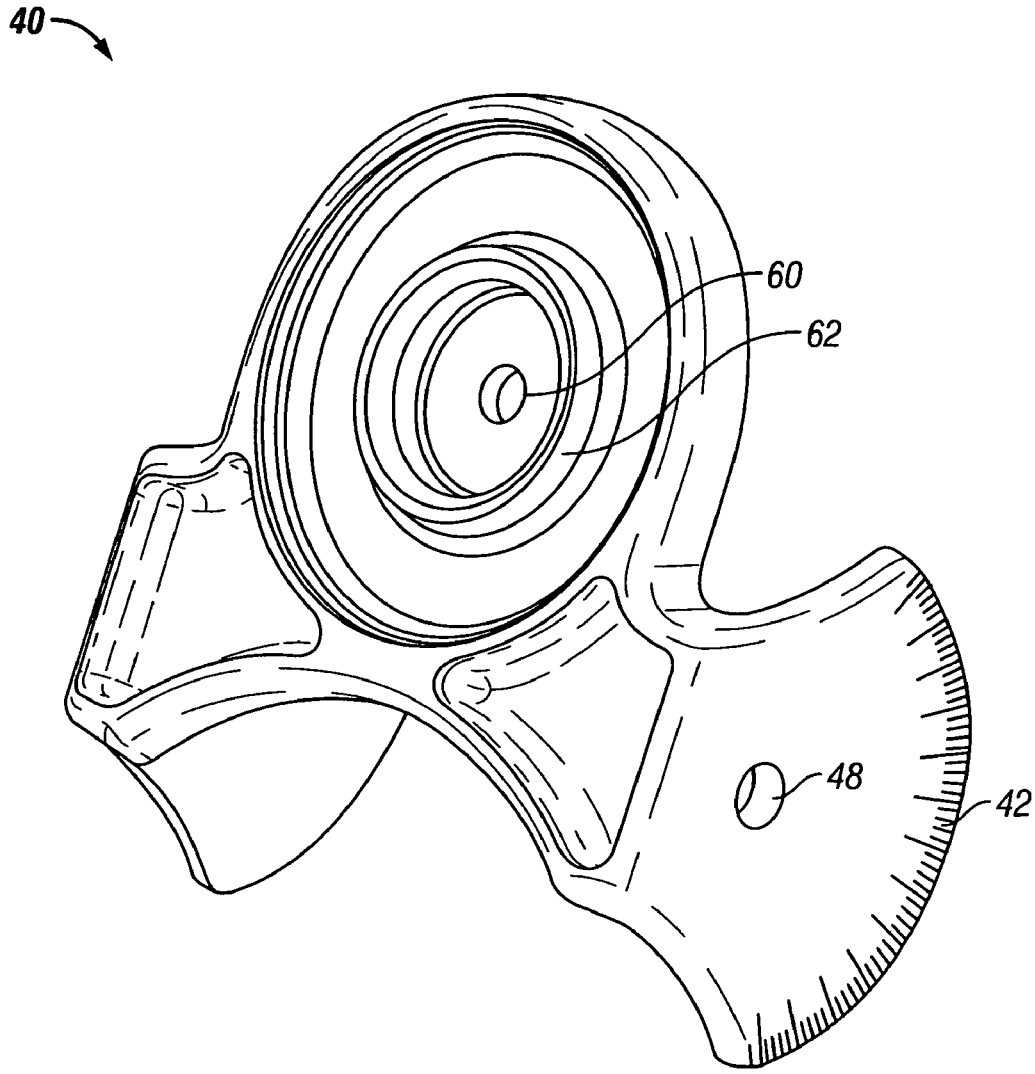
FIG. 3 is a view of a first bracket component of the sighting device of the present invention.
Figure 4:
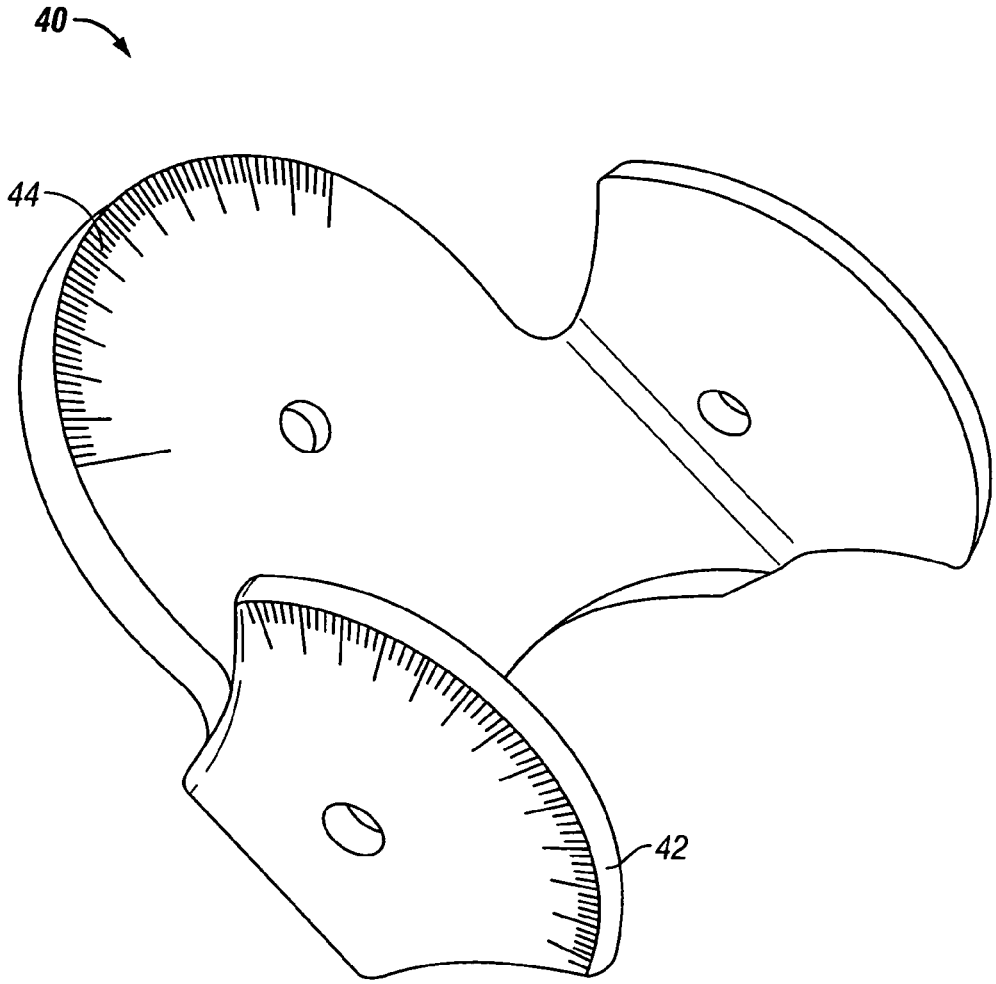
FIG. 4 is an alternative view of a first bracket component of the sighting device of the present invention.

A first bracket 40 is rotatably attached to body 12, preferably by means of a threaded screw or similar fixing structure transiting hole 60, with movement constrained to rotational movement by ring 62, all as shown in FIGS. 1 and 3. First bracket 40 includes skew or tilt markings 44, which preferably are degree skew markings, conventionally centered at 90° (i.e., vertical and not skewed or tilted), and subsuming about 60° to the right and left (i.e., with respect to the plane formed by the line of sight through viewing arm 14 and line of sight arm 16). The markings may be varied depending on the convention employed by various satellite dish receivers and other information sources; thus the markings may range from about 30° to about 150°, or may be centered on 90° and range from about 150° to about 30°, or may be centered on 0° and show a range from +60° to −60°. It may readily be appreciated that such markings are merely conventional, and that different conventions may readily be employed. A mark 32, as shown is FIG. 1, is preferably provided on body 12; when the skew marking is at 90° with respect to mark 32, a line through the midpoint of first bracket 40 and mark 32 is parallel with the plane formed by the line of sight through viewing arm 14 and line of sight arm 16.

The screw or other fixing structure transiting hole 60 is preferably adjustable, such that it may be loosened to permit rotation of first bracket 40 to any desired angle as shown on markings 44, and may thereafter be tightened or otherwise secured to prevent further rotation. While a conventional screw, such as a knurled screw, may be employed, other tightening means may also be employed, including various friction fittings, compression fittings and the like.

Second bracket 50 is transversely mounted to first bracket 40, such as by means of knurled screw 46 which transits hole 48 in first bracket 40 and further transits elongated cylindrical hole 64 forming a part of bracket 50. In one embodiment, screw 46 terminates in a threaded hole on first bracket 40 opposing hole 48. First bracket 40 includes elevation markings 42, which preferably are degree elevation markings, subsuming from about 0° to more than about 60° with respect to the line of sight of line of sight arm 16, with a mark 58 on second bracket 50, it being understood that when the second bracket 50 is rotated such that mark 58 is opposite the 0° marking on elevation markings 42, that the second bracket 50 is coaxial with line of sight arm 16, and is at a right angle to the base of first bracket 40.

Figure 5:
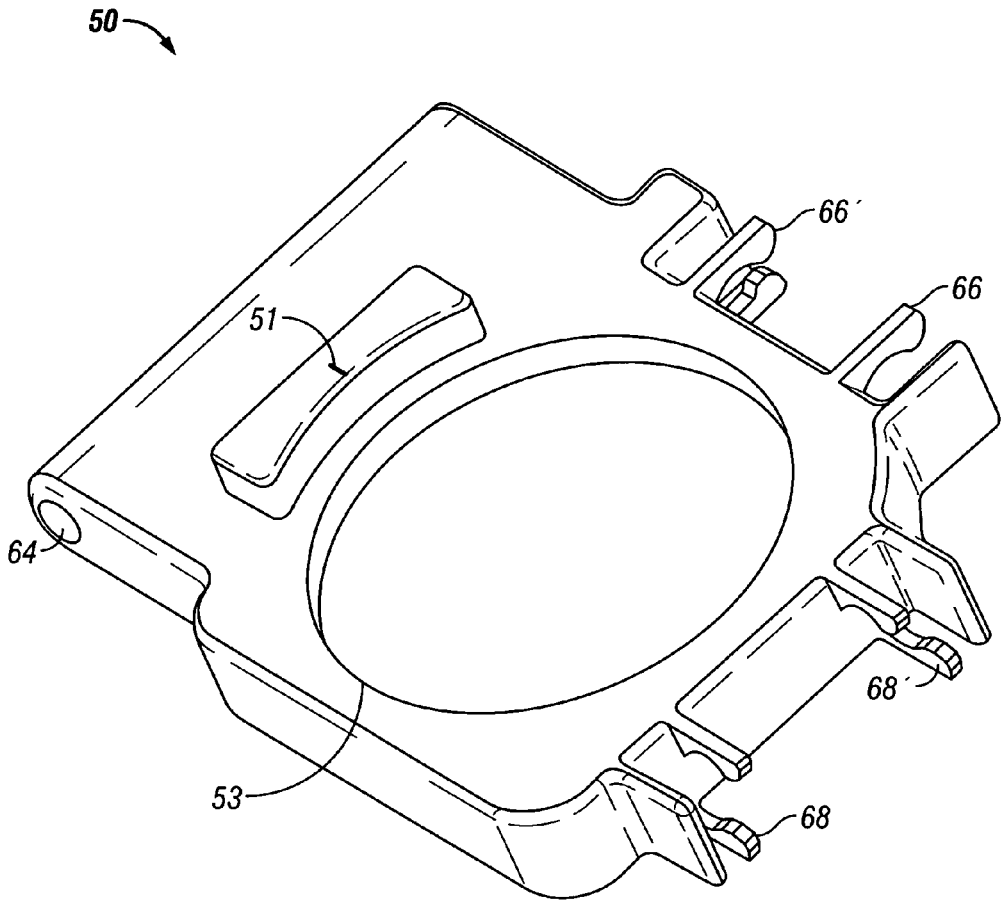
FIG. 5 is a three-quarter top view of a second bracket component of the sighting device of the present invention.
Figure 6:
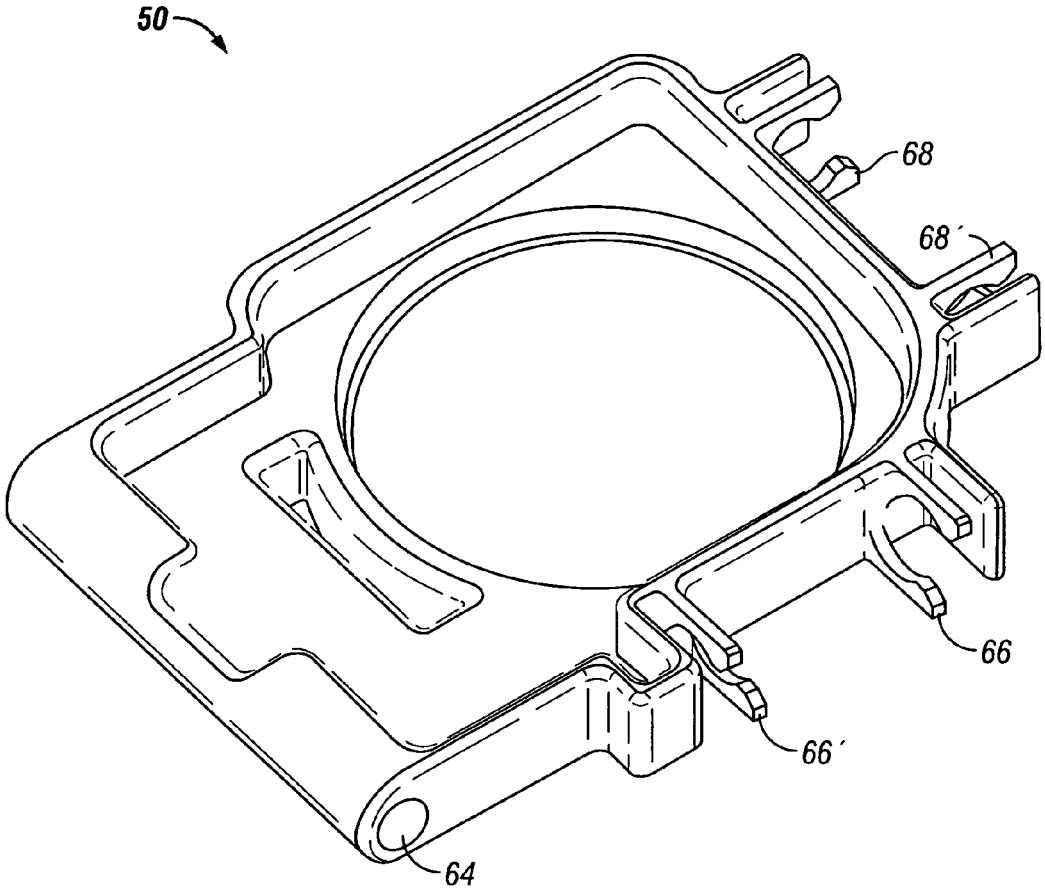
FIG. 6 is a three-quarter bottom view of a second bracket component of the sighting device of the present invention.

Second bracket 50 further includes clips 66, 66' and 68, 68' for securing tubular bubble levels 54 and 52, respectively. Tubular bubble levels 54, 52 are used as normal levels, i.e., when the bubble is between the two lines, the device is "level" with respect to the long axis of the tubular bubble level. In the present invention, these level bubbles can act as indicators to determine when sighting device 10 is level in the desired axes. Preferably clips 66, 66' are at right angles to clips 68, 68', with one pair thereof parallel to the plane formed by the line of sight through viewing arm 14 and line of sight arm 16, and the other pair thereof perpendicular thereto. While use of two tubular bubble levels is preferred, since it permits leveling in the two critical axes, other leveling means may be employed. For example, a circular bubble level may be employed. Similarly, any of a variety of electronic or mechanical level indicators may be similarly employed. Compass 56 is secured within the provided hole 53 of second bracket 50, with compass 56 further comprising a rotatable ring or bezel having directional indicators thereon (e.g., "north") and preferably degree markers, such as markers for every 2°. A mark 51, as shown in FIG. 5, is preferably provided on second bracket 50, and is co-planar with the plane formed by the line of sight through viewing arm 14 and line of sight arm 16.

Compass 56 is a rotatably adjustable magnetic north compass, which may include indicators, such as a separate adjustable needle marker, for compensation for any magnetic deviation. Thus deviation, including but not limited to magnetic declination (the difference at a locale between true north and magnetic north) may be adjusted for in use of compass 56. Compass 56 is, in one preferred embodiment, a liquid-filled compass with a plastic case, lens or lenses, and rotating ring or bezel.

Figure 7:
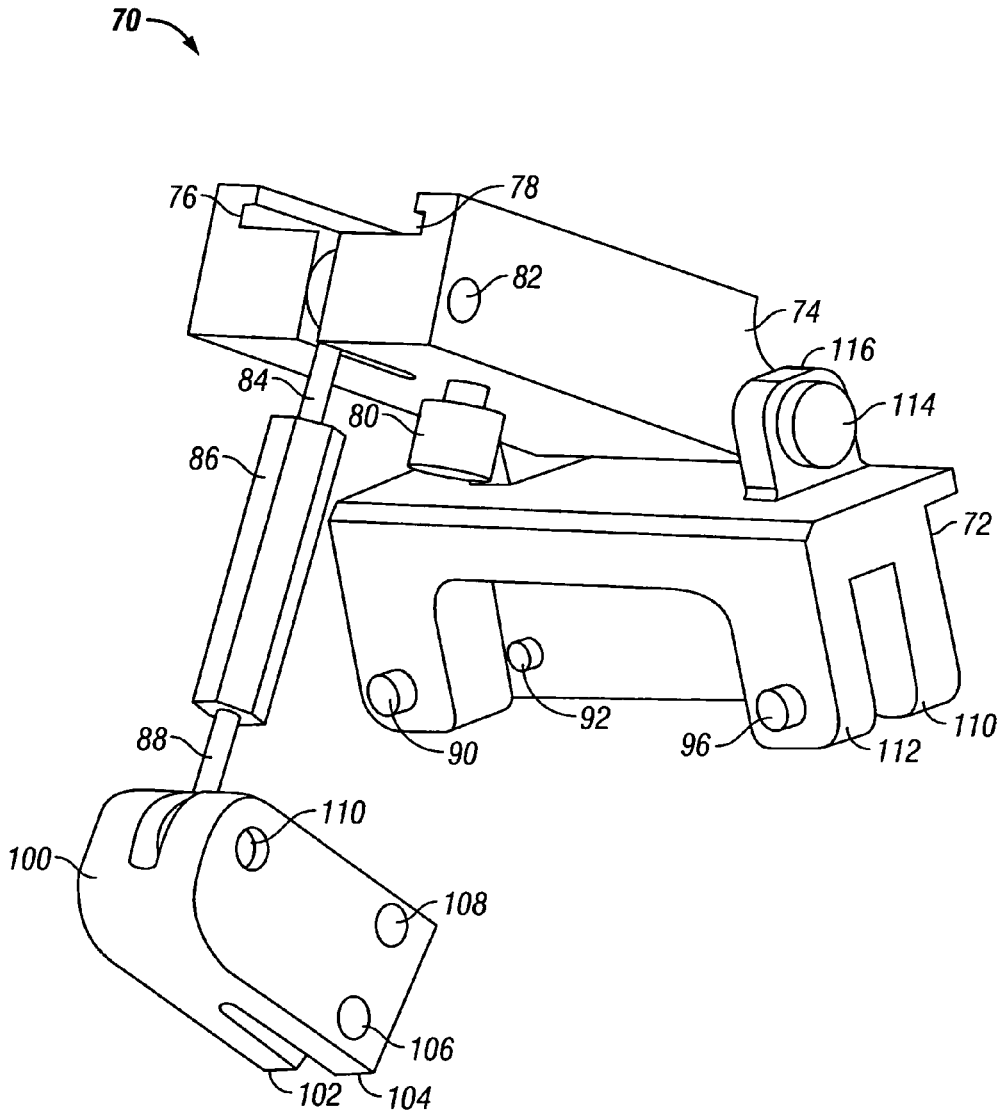
FIG. 7 is side view of a mounting bracket of the present invention for securing the sighting device to a satellite dish.
Figure 8:
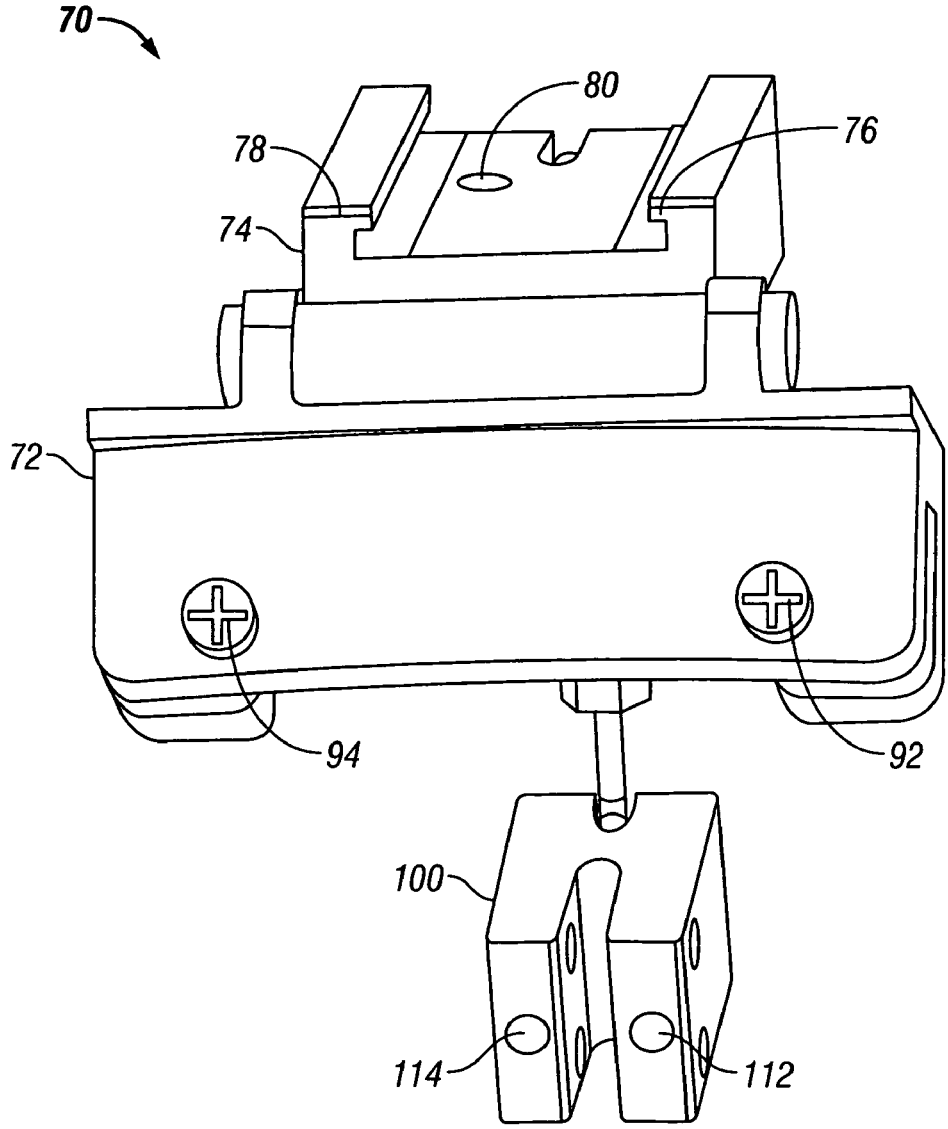
FIG. 8 is front view of a mounting bracket of the present invention for securing the sighting device to a satellite dish.

The body 12 of the sighting device 10 also preferably includes rails 18 which may be employed for fixing the body 12 to a mounting bracket 70 as shown in FIGS. 7 and 8. Mounting bracket 70 includes a holder 74, which includes grooved members 76, 78 for receiving rails 18 of body 12. Body 12 is secured within the holder 74 by suitable fixing means, such as holding screw 80 with a knurled knob. Holder 74 is secured to clamp 72, such as by means of screw 114 which transits leg 116 and is secured to holder 74. Holder 74 further includes a screw 82, such as a dog point screw, for fastening to eyebolt 84 which is threadably engaged with turnbuckle 86. The opposing end of turnbuckle 86 is threadably engaged with reverse thread eyebolt 88, such that rotating turnbuckle 86 in one direction causes the length of the combination of eyebolts 84, 88 and turnbuckle 86 to become longer, and rotating in the opposite direction causes the combination to become shorter. The turnbuckle 86 may be fixed in position by conventional means, such as by use of one or more lock nuts positioned along one or more of eyebolts 84, 88.

Eyebolt 88 is in turn fixed to foot 100, such as through means of screw 110, which may similarly be a dog point screw. Foot 100 has legs 102 and 104, such legs including plurality of holes, preferably threaded cylindrical holes, for fixing foot 100 to a satellite dish. For satellite dishes with a ribbed structure, legs 102 and 104 may be positioned such that the legs straddle a rib, and are secured by means of set screws, such as through holes 106, 108. Alternatively, one or more holes may be drilled through the satellite dish, and foot 100 secured to the dish by screws, such as sheet metal or other screws that transit the dish and are fastened into the foot 100, such as into threaded holes 112, 114.

Clamp 72 includes legs 110, 112 for straddling an edge of a satellite dish. Clamp 72 may be secured to the dish by any means, such as by set screws 90, 96, or by sheet metal screws 92, 94 which transit the dish edge and are screwably engaged into clamp 72.

Mounting bracket 70 is preferably fully adjustable such that it will fit and function with any dish, including internet satellite dishes and dual or multiple LNB satellite dishes, and may be adjusted such that the line of sight of sighting device 10 is coaxial with the line of sight of the satellite dish and/or the arm angle of the satellite dish receiving portion. Thus in a preferred embodiment the mounting portion attached to the satellite dish can be adjusted to any angle to conform to any dish configuration such that the sighting portion of sighting device 10 is coaxial with the satellite reception line for the dish.

It is to be appreciated that alternative designs for mounting bracket 70 are both possible and contemplated. For example, it may include an arm that is adjustable in length by means of screw actuated structures, slidable structures, spacer bushing structures or the like. Preferably mounting bracket 70 is made, in large part or wholly, from a hard plastic or other similar material, most preferably non-ferrous and of a material that does not exhibit ferromagnetism. Alternatively, the mounting bracket 70, may be designed for easy removal from a dish, by means of clamps, slots, tabs or other attachment means. The mounting bracket may further be located at other positions on a dish; in one preferred embodiment the mounting bracket is attached to the LNB arm of the satellite dish.

Figure 9:
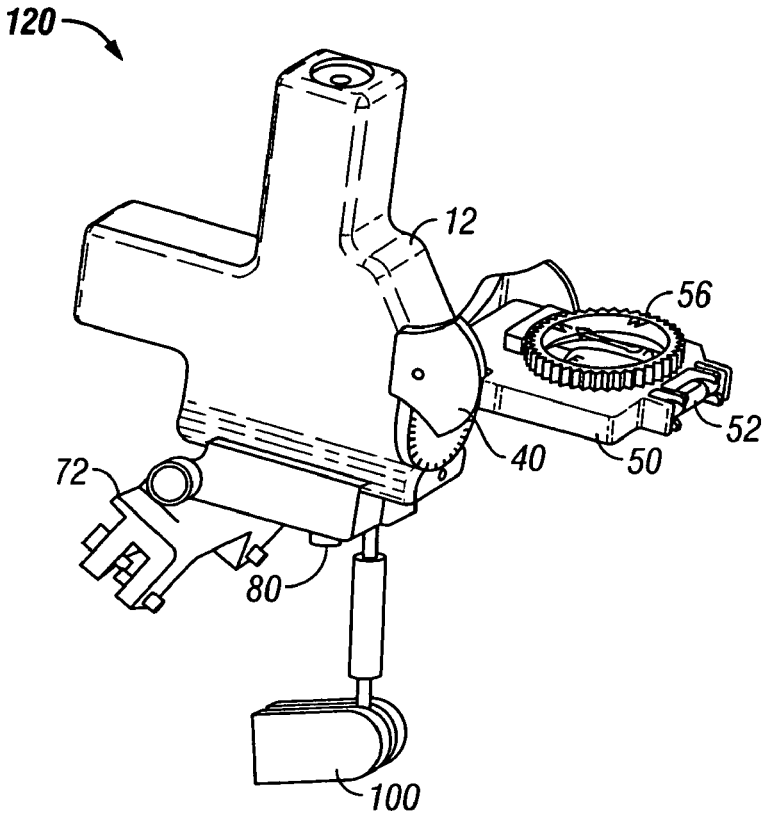
FIG. 9 is a side view of the sighting device of the present invention mounted on a mounting bracket of the present invention.
Figure 10:
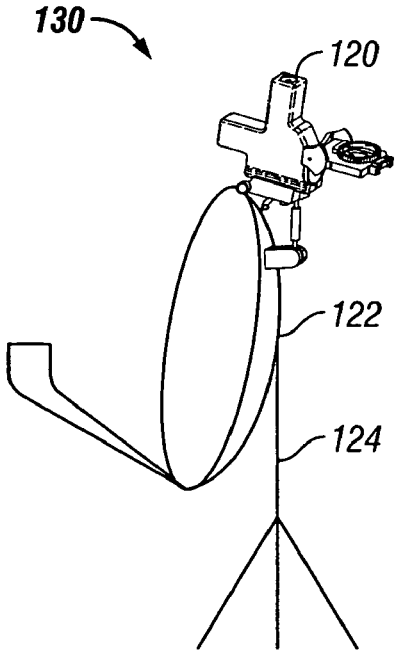
FIG. 10 is a side view of the sighting device of the present invention mounted on a mounting bracket of the present invention which in turn is attached to a satellite dish.

The completed assembly 120, consisting of sighting device 10 and mounting bracket 70, is depicted in FIG. 9, and the completed system 130, consisting of assembly 120 mounted on dish 122, which in turn is held in place by tripod 124, is shown in FIG. 10.

In use, the position of one or more satellites from the specific geographic location where the dish is located is determined. The position is typically reported in at least compass azimuth orientation (typically utilizing local magnetic compass orientation), degrees of elevation from the horizon or meridian, and skew or tilt, particularly for dual or multi-satellite dishes. The position may be obtained from Internet sites, from telephone calls to service bureaus, from printed publications listing satellite positions, from the satellite receiver itself and the like.

The position is thus obtained in terms of compass azimuth orientation (e.g., 176.2°), elevation or altitude (e.g., 52.2°) and skew or tilt (e.g., 84.5°). To determine whether a clear line of sight is available for the dish at a particular location, compass 56 is rotated to the correct azimuth orientation and the elevation angle is set by means of elevation markings 42 with respect to mark 58. For simply determining whether the location provides a suitable clear line of sight, it is generally not required to set the skew or tilt angle. The user stands in a proposed location for the dish, holds sighting device 10 in the correct azimuth orientation as shown on compass 56, and levels sighting device 10 by means of tubular bubble levels 54, 52. The user then views through the sighting device 10, such as by looking through lens 20 of arm 14. The view subsumes a defined angular field of view, such as 5°. If the line of site within the angular field of view is clear and unobstructed, then a satellite signal may be obtained from that location. If the line of sight is obstructed, another location is selected and evaluated, until a position is found which affords a free line of site. For use with multiple satellites, using the degree reference markers on the compass, the user looks the desired number of degrees left and right, and determines whether the line of sight is obstructed.

To align a satellite dish, mounting bracket 70 is first affixed to the satellite dish such that the line of sight of sighting device 10 is coaxial with the satellite reception line for the dish. This may conveniently be done by establishing that the dish stand pole is completely vertical or plumb in all orientations, and utilizing the sighting device 10 to align the mounting bracket 70, typically by providing for no skew or tilt, and setting the elevation angle on the sighting device 10 to the same angle as the dish angle with respect to the dish stand pole, such as for example 30°. However, once mounting bracket 70 is properly aligned to the satellite dish, it is not thereafter necessary to perform this procedure. Advantageously, because the sighting device 10 is aligned to the satellite dish by means of properly oriented mounting bracket 70, it is not thereafter necessary, in use of the satellite dish, to have the dish stand pole vertical or plumb. This thus facilitates use in rough or uneven terrain. The sighting device 10 is set to the correct parameters as described above, including compass orientation or azimuth, elevation angle and skew or tilt angle, using predetermined parameters. Most conveniently, such parameters may be obtained from the satellite receiver. Sighting device 10 is then fixed into mounting bracket 70, such as by tightening holding screw 80, thereby forming completed assembly 120, and the dish itself is adjusted until the compass orientation as shown on compass 56 is correct and the assembly is level as shown by use of bubble levels 52, 54. The dish is then aligned as required to obtain the desired satellite signal. That the line of sight is clear may further be verified after positioning by viewing through sighting device 10, such as by looking through lens 20 of arm 14.

In alternative embodiments the compass portion of the sighting mechanism may be attached to the side or front of the sighting mechanism. Alternative embodiments include, but are not limited to, use of the apparatus on a stationary satellite dish; permanent mounting of the apparatus to a satellite dish; automating or computerizing the apparatus; attachment of or use of the apparatus with a global positioning system (GPS) for determining the precise location of the proposed satellite dish and other variables, including azimuth; use of the apparatus on or with a telescope or other device which must be precisely positioned with respect to known celestial coordinates; and use of the apparatus on any device requiring the receipt or transmission of a directed signal to or from a distant object that is within a line of sight.

Other alternative embodiments include, but are not limited to, the use of an electronic or computerized compass system; other mirror or optical arrays, including the use of a prism, single mirror or other optical components; electronic or computerized leveling devices or mechanisms; or any combination of the above with the preferred embodiment.

It may thus be seen that the device may be partially or fully automated, such as by means of a keypad for input of relevant settings, servo or stepper motors to set azimuth, altitude, skew and the like, auditory or visual displays to indicate correct compass and level orientation, and the like, together with appropriate control circuits or other logic control means. However, manual setting of compass orientation, altitude and skew, as described above, are sufficient to orient a satellite dish with the accuracy and precision required for the intended purpose.

While the preferred embodiment of the invention is directed to positioning RV satellite dishes, the invention can be employed in positioning home satellite dishes, portable internet access satellite dishes, and generally any satellite dish, whether or not for commercial television, and in particular any satellite dish utilizing or receiving a signal from a satellite in a geosynchronous orbit.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A device for selection of a clear line of sight for a satellite dish and for aligning a satellite dish, comprising:

a body with a viewing tube for viewing a line of sight;

a first bracket attached to the body and rotatably movable around a line coaxial with the line of sight of the viewing tube; and a second bracket attached to the first bracket, and rotatably movable along a line perpendicular to the line coaxial with the line of sight of the viewing tube, the second bracket comprising a compass and at least one level indicator.

2. The device of claim 1, wherein the viewing tube comprises a telescopic viewing tube.

3. The device of claim 1, wherein the viewing tube comprises two elongated segments at a non-zero angle one to the other and an optical component whereby light is transmitted at the non-zero angle of the two segments.

4. The device of claim 3, wherein the two segments are at a right angle one to the other, and the optical component comprises a mirror or a prism.

5. The device of claim 4, wherein the optical component comprises two mirrors, with each mirror disposed at a 45° angle to the axis of light transmission, whereby light is transmitted along the viewing tube at a 90° angle.

6. The device of claim 1, wherein the first bracket further comprises degree markings for setting a skew angle of the first bracket to the body.

7. The device of claim 1, wherein the first bracket further comprises degree markings for setting an elevation angle of the first bracket to the second bracket.

8. The device of claim 1, wherein the compass comprises a rotatable element with directional markings for setting an azimuth angle with respect to the line of sight of the viewing tube.

9. The device of claim 1, wherein the second bracket comprises two level indicators, with a first level indicator parallel to line of sight of the viewing tube and a second level indicator perpendicular to the line of sight of the viewing tube.

10. The device of claim 9, wherein the first level indicator and the second level indicator comprise tubular bubble levels.

11. The device of claim 1, wherein the viewing tube subsumes a defined angular field of view.

12. The device of claim 11, wherein the defined angular field of view is an angle between about 3° and about 9°.

13. The device of claim 1, wherein the device is made from materials that do not exhibit ferromagnetism.

14. The device of claim 1, further comprising a mounting bracket with a securing member for securing the body to the mounting bracket and an adjustable member for adjustably mounting the mounting bracket to a satellite dish.

15. The device of claim 14, wherein the adjustable member may be adjusted such that the line of sight of the viewing tube is coaxial with the satellite reception line for the satellite dish.

16. The device of claim 14, wherein the securing member comprises at least one groove and the body comprises at least one complementary rail, whereby the body can be removably secured to the mounting bracket.

17. The device of claim 14, wherein the adjustable member comprises at least one elongated structure with a variable length.

18. A system for selection of a clear line of sight for a satellite dish and for aligning a satellite dish with respect to a determined satellite, comprising:

a body with a viewing tube for viewing a line of sight;

a first bracket attached to the body and rotatably movable around a line coaxial with the line of sight of the viewing tube;

a second bracket attached to the first bracket, and rotatably movable along a line perpendicular to the line coaxial with the line of sight of the viewing tube, the second bracket comprising a compass and at least one level indicator; and a mounting bracket with a securing member for securing the body to the mounting bracket and an adjustable member for adjustably mounting the mounting bracket to a satellite dish, wherein the line of sight of the viewing dish is coaxial with the reception line of the satellite dish with respect to a determined satellite.

19. A method for aligning a satellite dish with respect to a known geosynchronous satellite, comprising the steps of:

obtaining the azimuth angle and altitude angle of a known geosynchronous satellite with respect to a defined locale;

providing a body with a viewing tube for viewing a line of sight, a first bracket attached to the body and rotatably movable around a line coaxial with the line of sight of the viewing tube, and a second bracket attached to the first bracket, and rotatably movable along a line perpendicular to the line coaxial with the line of sight of the viewing tube, the second bracket comprising a compass and at least one level indicator;

rotatably adjusting the second bracket to set the second bracket at an angle to the line of sight corresponding to the altitude angle;

orienting the body to a compass angle corresponding to the azimuth angle by means of the compass; and leveling the second bracket by means of at least one level indicator.

20. The method of claim 19, further comprising the steps of:

obtaining the skew angle of a known geosynchronous satellite with respect to a defined locale;

fixing the body to a satellite dish such that the line of sight of the viewing tube is coaxial with the reception line of the satellite dish; and rotatably adjusting the first bracket to the set the first bracket at an angle corresponding to the skew angle.

* * * * *